US006435747B2

(12) United States Patent
Furukawa et al.

(10) Patent No.: US 6,435,747 B2
(45) Date of Patent: Aug. 20, 2002

(54) DOUBLE ENDED DIRECT-FEED TYPE WRITING IMPLEMENT

(75) Inventors: Kazuhiko Furukawa, Kanagawa; Hiroaki Koyama; Takeshi Kobayashi, both of Yokohama; Yojiro Sano, Tokyo; Yosuke Mito, Yokohama, all of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/779,176

(22) Filed: Feb. 8, 2001

(30) Foreign Application Priority Data

Feb. 9, 2000 (JP) ..... 2000-031391

(51) Int. Cl.[7] ..... B43K 27/00

(52) U.S. Cl. ..... 401/34; 401/148; 401/151; 401/199; 401/206; 401/212; 401/217

(58) Field of Search ..... 401/34, 36, 28, 401/148, 151, 199, 206, 212, 217

(56) References Cited

U.S. PATENT DOCUMENTS 3,025,834 A * 3/1962 Aaron ..... 401/34
3,216,398 A * 11/1965 Washcalus ..... 401/217
3,951,555 A * 4/1976 Wittnebert et al. ..... 401/199 X
4,685,820 A * 8/1987 Kremer et al. ..... 401/34 X
5,929,135 A * 7/1999 Wasai et al. ..... 401/209 X

FOREIGN PATENT DOCUMENTS

JP 06-20084 3/1994 ..... B43K/7/02
JP 09-020094 1/1997 ..... B43K/7/02

* cited by examiner

*Primary Examiner*—Gregory L. Huson
*Assistant Examiner*—Kathleen J. Prunner
(74) *Attorney, Agent, or Firm*—Darby & Darby

(57) ABSTRACT

A direct-feed type writing implement having two ends includes an ink tank and a pair of writing points, arranged at opposite ends of the ink tank. An ink collector is provided for each writing point. An air/liquid exchanger adjusts the internal pressure inside the ink tank by use of capillarity. An ink feeder is provided for each writing point. Each ink feeder includes a center core for feeding ink to the writing point. Air is inhibited from flowing into the ink tank through the ink collector air/liquid exchanger located at one end while the pen is being used for writing at the opposite end.

16 Claims, 11 Drawing Sheets

DOUBLE ENDED DIRECT-FEED TYPE WRITING IMPLEMENT

BACKGROUND OF THE INVENTION (1) Field of the Invention

The present invention relates to a double. ended direct-feed type writing implement having writing points (point assemblies) on both ends of the barrel.

(2) Description of the Prior Art

A typical, so-called double ended writing implement incorporates an ink absorbent element inside its ink tank with the whole ink inside the ink tank being absorbed in the ink absorbent element. The writing implement of this type has advantages in being assembled easily, but because ink absorbed in the sliver moves down due to gravity, much ink ejects out from one of the writing points (point assemblies) while extremely less amounts of ink eject out from the other writing point (point assembly), causing thinning of lines and ink starving.

Since an ink absorbent element in this type of pen makes use of capillarity, the ejected amount of ink gradually decreases as writing continues, so it is impossible to provide stable and consistent ink ejection until ink end or the last drop of ink.

Further, while a direct-feed type writing implement makes it possible to monitor the residual quantity of ink, a writing implement using an ink absorbent element cannot allow the residual quantity of ink to be seen. In order to solve the above problems and drawbacks of the double ended writing implements using an ink absorbent element, there has been an idea that the ink is made to directly fill the ink tank without any ink absorbent element and two ink collectors, which prevent ink leakage due to air expansion inside the ink tank caused by decrease in pressure and increase in temperature, are arranged on both ends. In this case, each ink collector needs to have an air/liquid exchanger allowing air to enter the ink tank as ink is consumed. In the state where both the caps to be placed on both ends of the ink tank are off, the air/liquid exchanger positioned at the top cannot be closed because the ink moves down pooling in the bottom inside the ink tank. Therefore, the interior and exterior of the ink tank communicate with each other through this air/liquid exchanger so that air flows into the ink tank via the air/liquid exchanger. As a result, the weight of ink or ink head directly acts on the writing point (point assembly) at the writing end, causing so-called forward leakage, i.e., ink to leak out from the writing point (point assembly), staining the paper surface, clothes and the like. If the cap has a sealing configuration, the sealing surface may be damaged, soiled with dirt and dust. In such a case, sealing becomes imperfect, causing the same problem, i.e., forward leakage.

Japanese Utility Model Application Laid-Open Hei 6 No.20084 discloses an arrangement which fills the ink tank with ink without using any ink absorbent element by letting an ink collector prevent ink leakage due to air expansion inside the ink tank due to decrease in pressure and increase in temperature. This specification discloses a double ended direct-feed type writing implement. The embodiment of this disclosure uses an ink collector arranged around the ink tank so it has the drawback that the residual quantity of ink inside the ink tank cannot be monitored. Even with a transparent ink collector, if this ink collector actually functions against decrease in pressure or increase in temperature, having been wetted with ink, it is difficult to see the residual quantity of ink.

Another known conventional example of double ended writing implement has an ink tank with two sections divided by a partition therein, each having an individual writing point (point assembly). With this configuration, if one writing point(point assembly) is used more frequently than the other, the ink inside the ink tank for the more frequently used writing point will be used up earlier, so that the usability of the double ended writing implement, that is, capability of using both writing points (point assemblies), cannot be obtained. In some cases, the writing implement might be discarded because of one of the tips is used up, resulting in poor economy.

Further, in general, direct-feed type writing implements, if the ink tank is affected by heat or reduction in pressure, air inside ink tank expands, and this expanded air forces ink out of the pen. This is why the ink collector is provided so as to prevent ink leakage outside the pen. However, there is a problem that the ink may leak out of the pen, causing ejection or flooding of ink if an air expansion is too large beyond the retaining capability of the ink collector.

SUMMARY OF THE INVENTION

It is therefore an object of the present invention to provide a double ended direct-feed type writing implement with an ink tank directly filled up with ink, still free from the above problems.

More specifically, the object of the invention is to provide a double ended direct-feed type writing implement which allows the residual quantity of ink to be monitored, assures a stable and consistent ink flow until ink end, and enables continuous flow of ink from both ends until the ink inside the ink tank is fully used up. A further object of the present invention is to provide a double ended direct-feed type writing implement which is free from the forward leakage problem which would occur when ink collectors are provided at both ends of the ink tank.

Still more, it is an object of the present invention to provide a double ended direct-feed type writing implement which is prevented from ink election or flooding due to decrease in pressure and increase in temperature of the ink tank, which is the problem inherent in writing implements of a direct-feed type.

The present invention has been devised to attain the above objects, and the present invention is configured as follows:

In accordance with the first aspect of the present invention, a double ended direct-feed type writing implement includes: an ink tank; a pair of writing points (point assemblies) as writing elements, arranged both ends of the ink tank; an ink collector, provided for each writing point, and having an air/liquid exchanger for adjusting the internal pressure inside the ink tank by making use of capillarity; an ink feeder means, provided for each writing point, and including a center core for feeding ink to the writing point (point assembly); and means for inhibiting air from flowing into the ink tank through the ink collector air/liquid exchanger located at the top while the pen is unused for writing.

In accordance with the second aspect of the present invention, the double ended direct-feed type writing implement having the above first feature is characterized in that one feeder means including a center core and the like is connected to the other.

In accordance with the third aspect of the present invention, the double ended direct-feed type writing implement having the above first feature is characterized in that an ink tank partitioning element is formed inside the ink tank and the feeder means including a center core and the like is extended to the ink storage pool created by the ink tank partitioning element.

In accordance with the fourth aspect of the present invention, the double ended direct-feed type writing implement having the above first feature is characterized in that an ink tank partitioning element with a passage hole formed therein is formed inside the ink tank, and the ink feeder means is penetrated through the passage hole of the ink tank partitioning element.

In accordance with the fifth aspect of the present invention, the double ended direct-feed type writing implement having the above first feature is characterized in that the ink collector space of one ink collector and that of the other ink collector are connected to each other by way of an air flowing passage.

In accordance with the sixth aspect of the present invention, the double ended direct-feed type writing implement having the above first feature is characterized in that at least one of the writing points (point assemblies) is of a ball-point type, and the ball-point type writing point (point assembly) has a spring inserted into the bore thereof and pressing the rear side of the writing ball rotatably held at the front part thereof , whereby the writing ball is abutted in fluid-tight contact with the inner brim of the ball holding portion of the point assembly to prevent outflow of ink.

In accordance with the seventh aspect of the present invention, the double ended direct-feed type writing implement having the above first feature is characterized in that at least one end of the writing points comprised of a joint which is connected to the rear end of the writing point (point assembly) and has a valve chamber at the rear thereof, the valve chamber having a tapered or spherical ball valve seat in the rear thereof and idly holding a ball valve therein, and when the writing point (point assembly) is set upward, the ball valve is in close contact with the ball valve seat so as to close the conduit fluid-tightly to thereby prevent backward leakage of ink, and when the writing point (point assembly) is set downwards, the hermetic contact state is released so as to allow ink to flow into the writing point (point assembly).

In accordance with the eighth aspect of the present invention, the double ended direct-feed type writing implement having the above first feature is characterized in that a fine hole is formed between the ink collector space of each ink collector and the ink conduit hole in which the ink feeder means including a center core and the like is disposed.

In accordance with the ninth aspect of the present invention, the double ended direct-feed type writing implement having the above first feature is characterized in that the ink feeder portion for leading ink held in the ink feeder means or in the ink absorbent element is connected to the air/liquid exchanger.

The double ended direct-feed type writing implement of the present invention has the means for inhibiting air from flowing into the ink tank through the ink collector air/liquid exchanger located at the top while the pen is unused for writing. Therefore, this configuration inhibits forward leakage from the writing point (point assembly) located at the bottom due to inflow of air from the collector air/liquid exchanger at the top while the pen is unused for writing. More specifically, since the feeder means such as a center core etc., is able to lead ink to the air/liquid exchanger located at the top, an ink meniscus is formed around the exchanger, thus making it possible to prevent air inflow through the collector air/liquid exchanger at the top.

Since the writing implement of the present invention can use direct-feed type liquid ink, the residual quantity of ink can be monitored while stable and consistent ink ejection can be obtained until the ink end or the last drop of ink.

Further, since ink in the ink tank can be supplied to both writing points (point assemblies), both the writing points (point assemblies) can continue to be able to deliver ink without causing any ink starving in only one of them until the ink inside the ink tank is fully used up.

Additionally, since the ink collector-space of one ink collector is connected to that of the other ink collector by way of the air flowing passage, it is possible to reduce ink ejection or flooding due to expansion of air inside the ink tank, which is caused by decrease in pressure, increase in temperature and the like.

Finally, provision of a spring urging the rear side of the writing ball, provision of a joint idly holding a ball valve therein and/or provision of an ink feeder portion are effective in preventing forward leakage.

DESCRIPTION OF THE PREFERRED EMBODIMENTS

Figure 1:
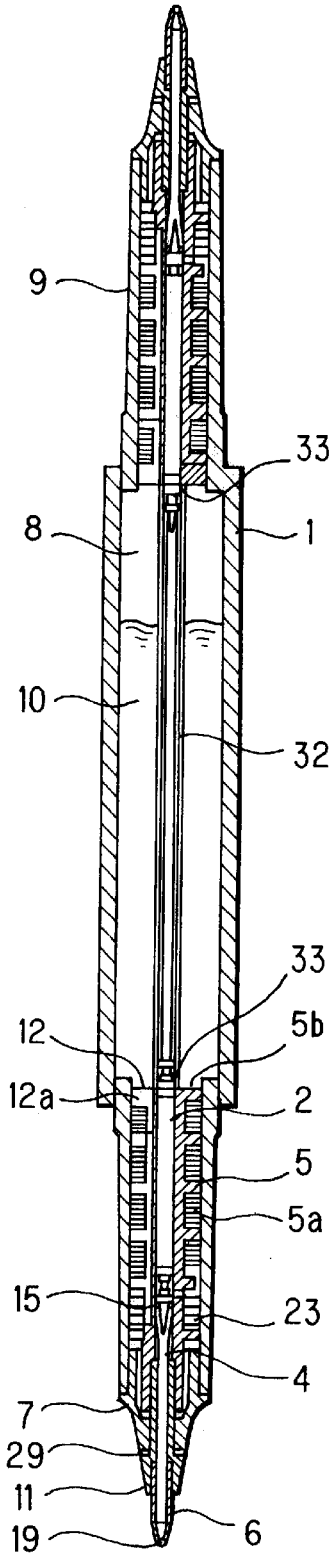
FIG. 1 is a vertical sectional view showing the overall configuration of a writing implement in accordance with the first embodiment of the present invention.

The embodiment of a double ended direct-feed type writing implement of the present invention will be described in detail with reference to the embodiments shown in the accompanying drawings. In the drawings of the embodiments herein, the writing implements are shown coinciding their axial direction with the vertical direction.

To begin with, main components used in each of the embodiments herein will be described.

An ink tank 1 is preferably transparent or translucent in order to allow the user to monitor the residual quantity of ink inside the ink tank. For example, resin such as polypropylene and the like can be used.

Barrels 9 also are preferably transparent or translucent. This is to provide easy check of the ink retained in an ink collector 5.

In the drawings, though ink tank 1 and barrels 9 are of separate components, there is no need to produce them as separate parts and they may be formed in one piece.

A feeder core 2, center core 4, ink absorbent element 32 may be of softly skinned and fixed, short or long fabric threads, as used conventionally, of a fiber bundle having long fabric threads shaped by adhesives or thermal bonding without using any skin, of an extruded plastic core having a snow-crystal shaped section, of a sintered core made up of small particles with spaces or pores, thermally fixed or bonded with adhesives, or of a sponge, as long as it is capable of holding ink to a certain degree or more.

Figure 6:
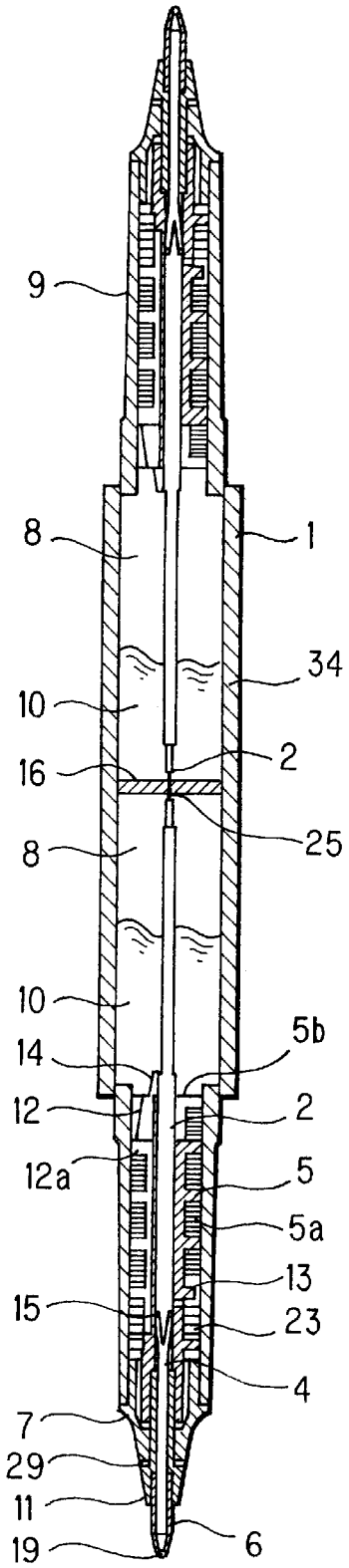
FIG. 6 is a vertical sectional view showing the overall configuration of a writing implement in accordance with the fourth embodiment of the present invention.

For feeder core 2, it may be formed of multiple parts as in the first embodiment shown in FIG. 1 and in the fourth embodiment shown in FIG. 6. Alternatively, it may be formed of a single piece as in the third embodiment shown in FIG. 4. Further, center core 4 and feeder core 2 may be formed in one piece. Ink absorbent element 32 may be used as a feeder core 2.

It is preferred that feeder core 2, center core 4 and ink absorbent element 32 are minimal in size. This is to secure volume for the liquid ink portion as large as possible, allow monitoring of the residual quantity of ink and enable stable ink ejection.

Ink collector 5 used in all the embodiments is a vane-adjuster type, but it is not limited to this type. A spongy or any other configuration may be used as long as it can retain ink temporarily.

Writing points (point assemblies) 6 shown in the embodiments of the present invention are of a ball-point type, but they are not limited to this. Fabric writing points, resin writing points and other point assemblies can be used.

Ink 10 may be a low (or medium) viscosity ink having a viscosity ranging from 2 to 100 mPa·S at room temperature (about 23° C.). Alternatively, a pseudo-plastic ink (also referred to as gel ink) which presents a higher viscosity in its stationary state to prevent forward leakage of ink seeping from the writing point and lowers its viscosity to permit smooth writing when the writing point is moved or stressed by shearing force during writing, may be used. As the solvent for the ink base, water, which is typical, may be used. Other than water, organic solvents such as lower alcohols, higher alcohols, xylene and the like, glycols such as ethylene glycol etc., and these esters which are applicable to ink for writing implements, may be used as appropriate.

Concerning air/liquid exchangers 12, a slit configuration is adopted in all the embodiments of the present invention, but a hole-type, for example, may also be used.

Next, each embodiment will be described. FIG. 1 is a vertical sectional view showing the overall configuration of a writing implement in accordance with the first embodiment of the present invention.

Barrels 9 are connected at both ends of an ink tank 1. For each end, a writing point (point assembly) 6, ink collector 5, feeder core 2, center core 4, plastic socket 7 and other necessary elements are provided. Ink tank 1 is filled up with ink 10. Feeder cores 2 at the top and bottom which are connected to respective center cores 4 are coupled by ink absorbent element 32.

Ink supply to writing point (point assembly) 6 in the present embodiment is performed by way of ink absorbent element 32, feeder cores 2 and center cores 4. As ink is consumed by writing, the volume of ink consumed should be compensated for with air. In this case, air compensation can be performed through the air/liquid exchanger 12 located at the bottom. Air can also enter the tank by way of the air/liquid exchanger 12 located at the top while writing. However, in order to prevent forward leakage when the pen is unused, entrance of air through the air/liquid exchanger 12 located at the top need to be prohibited.

Since ink absorbent element 32 and feeder core 2 suck ink 10 up and supply ink to writing point (point assembly) 6 located at the top, this, not only enables the writing point (point assembly) 6 at the top to write but at the same time wets the air/liquid exchanger 12 at the top, forming an ink meniscus. This formation of ink meniscus prevents air from flowing into ink-tank 1 through air/liquid exchanger 12 of the ink collector 5 at the top, thus making it possible to prevent forward leakage. With this configuration, it is possible to prevent forward leakage no matter whether the cap (not shown) is on. It should be noted as to the embodiments hereinbelow with no ink feeder portion 14 that both ends 33 of ink absorbent element 32 need to be set in contact with corresponding air/liquid exchangers 12 in order to prevent forward leakage. This requirement is to form meniscuses with air/liquid exchangers 12, and this prevents forward leakage. Instead of providing an ink absorbent element 32, the two feeder cores at the top and bottom may be connected directly. In this case, however, an arrangement for wetting air/liquid exchangers 12 should be provided.

Figure 2:
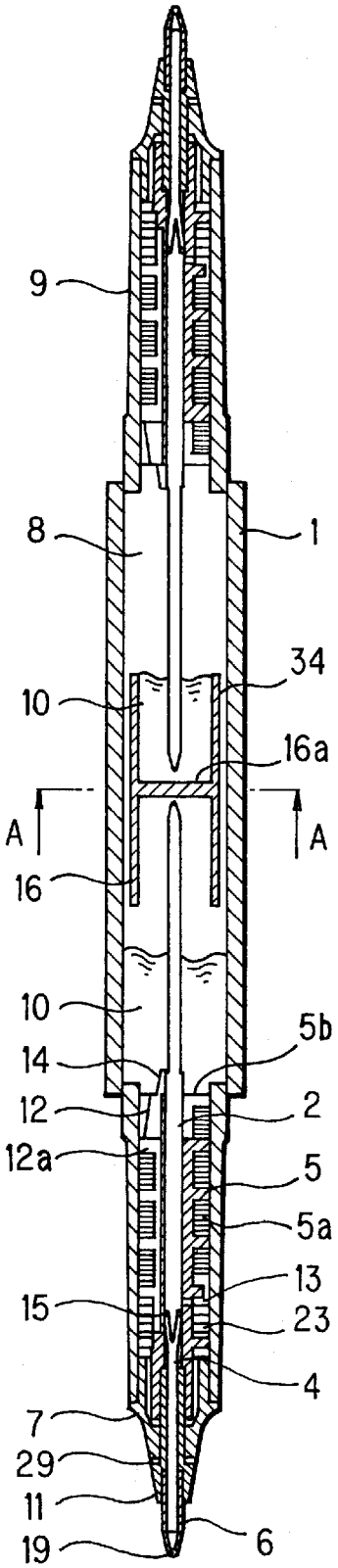
FIG. 2 is a vertical sectional view showing the overall configuration of a writing implement in accordance with the second embodiment of the present invention.
Figure 3:
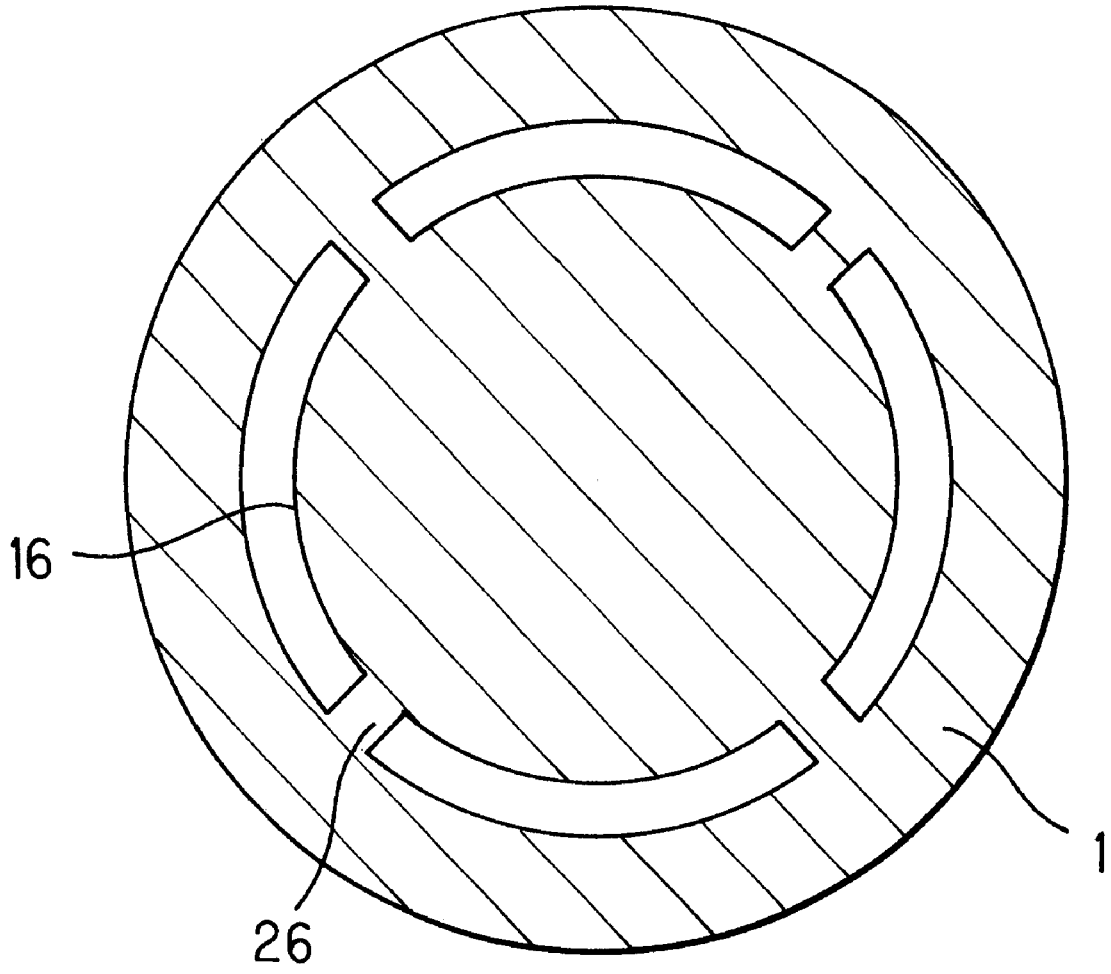
FIG. 3 is a sectional view cut along a plane A—A in FIG. 2.

FIG. 2 is a vertical sectional view showing the overall configuration of a writing implement in accordance with the second embodiment of the present invention. FIG. 3 is a sectional view cut along a plane A—A in FIG. 2. Provided in ink tank 1 is an ink tank partitioning element 16. A feeder means 2 such as center core etc., is extended to an ink pool 34 formed by ink tank partitioning element 16. Ink pool 34 is a cup-like configuration with a bottom and is defined by ink tank partitioning element 16. Though ink tank partitioning element 16 is arranged at the approximately center of the ink tank, it is not necessary to arrange it at the center. This ink tank partitioning element 16 may be formed integrally with the main barrel 1 by providing ribs 26, etc. Alternatively, the partitioning element may be fixed to the tank by press-fitting. Ink 10 is stored in ink pool 34 of ink tank partitioning element 16. Since the upper feeder core 2 is arranged to reach the bottom 16*a* of ink tank partitioning element 16, ink 10 stored therein can be fed to the writing point (point assembly) 6 located at the top so that the top writing point (point assembly) 6 is always ready to write.

Since ink tank partitioning element 16 defines channels between itself and barrel 1, ink can flow through these channels and hence can be supplied to both the upper and lower writing points (point assemblies) 6. As a result, both the upper and lower writing points (point assemblies) 6 can continuously distribute ink for writing until ink 10 inside ink tank 1 is used up.

The means against forward leakage of this embodiment is provision of ink feeder portions 14. Ink 10 in ink pool 34 of ink tank partitioning element 16 is also supplied to the upper ink feeder portion 14 by way of feeder core 2, forming a meniscus at air/liquid exchanger 12. This meniscus inhibits air from entering ink tank 1 through air/liquid exchanger 12 of the upper ink collector 5, thus preventing forward ink leakage from writing point (point assembly) 6 located at the lower end. Further, since provision of ink tank partitioning element 16 makes the distance from ink feeder portion 14 to ink 10 shorter than that in the configuration without any ink tank partitioning element 16, a more amount of ink can be fed to ink feeder portion 14. As a result, a more stable meniscus can be formed in this configuration, hence it is possible to prevent forward leakage in a more effective manner. The detail of ink feeder portion 14 will be described later.

Figure 4:
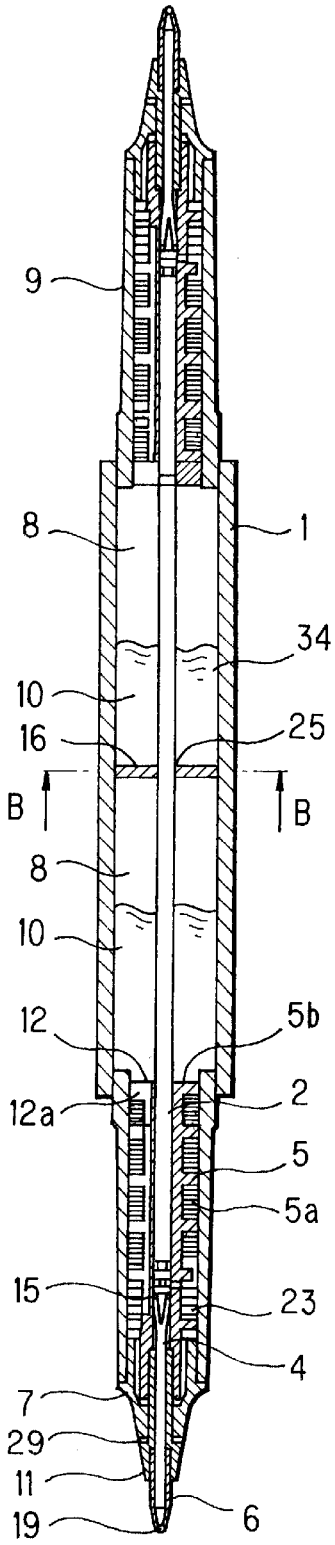
FIG. 4 is a vertical sectional view showing the overall configuration of a writing implement in accordance with the third embodiment of the present invention.
Figure 5:
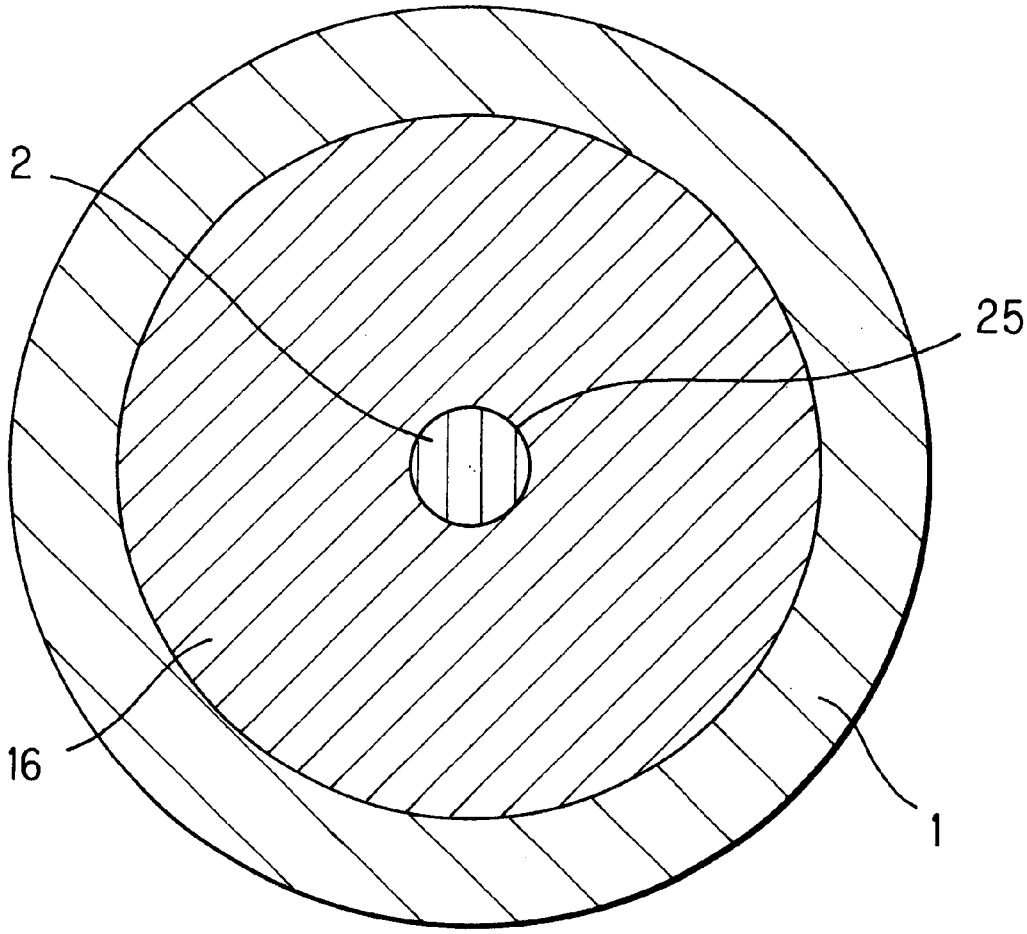
FIG. 5 is a sectional view cut along a plane B—B in FIG. 4.

FIG. 4 shows the third embodiment of the present invention. FIG. 5 is a sectional view cut along a plane B—B in the third embodiment. FIG. 6 shows a configuration in which a feeder core 2 penetrated through a passage hole 25 provided in ink tank partitioning element 16 is made thinner. The third embodiment is characterized by having an ink tank partitioning element 16 having a passage hole 25 with the ink feeder means 2 penetrated through passage hole 25 of the ink tank partitioning element 16.

Since the interior of ink tank 1 is sectioned by ink tank partitioning element 16, ink 10 can be stored also in the section (ink pool 34) above ink tank partitioning element 16. In this case, since the upper and lower sections of ink tank 1 are connected to each other by feeder core 2, the ink 10 in the upper section can be used from the writing point (point assembly) 6 at the bottom. In this way, both the writing points (point assemblies) 6 can distribute ink for writing until ink 10 inside ink tank 1 is used up. In a case where ink tank partitioning element 16 is arranged in order to section ink tank 1 as in this embodiment, ink pool 34 is defined by ink tank partitioning element 16 and the inner wall of ink tank 1.

The means for preventing forward leakage of this embodiment is the same as in the second embodiment. That is, the meniscus formed at air/liquid exchanger 12 with the help of ink feeder portion 14 inhibits air from entering, thus preventing forward leakage. Since the distance from air/liquid exchanger 12 to ink 10 is as short as in the second embodiment, forward leakage can be effectively prevented compared to the configuration without any ink tank partitioning element 16.

Further, in the present embodiment, provision of ink tank partitioning element 16 also presents the effect of reducing the leakage or ejection of ink 10 by way of a writing point vent hole 29 to the exterior of the pen when air in the empty space, designated at 8, inside ink tank 1 expands due to increase in temperature or reduction in pressure and the displaced ink exceeds the ink retaining capacity of the ink collector 5. More illustratively, in the third embodiment in FIG. 4, air in space 8 above and below inside ink tank 1 expands, the air in the upper space 8 breaks the meniscus at the upper air/liquid exchanger 12, passing through ink collector 5 and being released to the open air by way of pen point vent hole 29. When no ink tank partitioning element 16 is provided, part of the expanded air can be released externally via pen point vent hole 29 but the other of expanded air urges ink 10 towards the lower ink collector 5. The provision of ink tank partitioning element 16 can halve the volume of expanded air forcing ink 10 out. As a result, it is possible to reduce ink ejection or flooding compared to the configuration without any ink tank partitioning element 16. In order to reduce ink ejection more effectively, it is preferred to provide a configuration in which ink 10 is more unlikely to pass through feeder core 2 which is penetrated through passage hole 25 in ink tank partitioning element 16. For example, the porosity of feeder core 2 may be increased, or the feeder core may be thinned as in the embodiment shown in FIG. 6. On the other hand, in order to enable both the upper and lower writing points (point assemblies) 6 to distribute ink for writing until the ink inside ink tank 1 is fully used up, it is necessary to select the configuration of feeder core 2, which is penetrated through ink tank partitioning element 16, by achieving a suitable balance between performance against ink ejection and ease with which ink can move through the feeder core. Incidentally, the configuration in which ink 10 is more unlikely to pass through feeder core 2 which is penetrated through ink tank partitioning element 16 is also effective in preventing forward leakage. Even if the meniscus at air/liquid exchanger 12 for the writing point (point assembly) 6 at the top is broken, this feeder core 2 makes it difficult for ink to flow therethrough. Therefore, ink 10 inside the upper section of ink tank 1 will not fall toward the writing point (point assembly) 6 at the bottom immediately after the meniscus breaks. Therefore, in this case, it is preferred that ink can only move through this feeder core 2.

Figure 7:
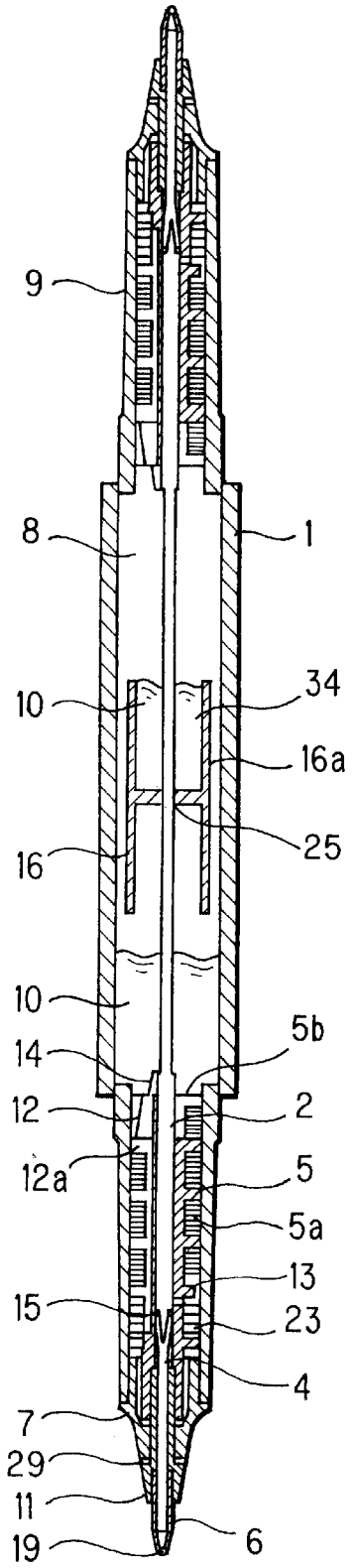
FIG. 7 is a vertical sectional view showing the overall configuration of a writing implement in accordance with the fifth embodiment of the present invention.

FIG. 7 shows a configuration wherein the ink tank partitioning element 16 of the third or fourth embodiment shown in FIGS. 4 through 6 is replaced with cup-like structures with bottoms.

In the second embodiment shown in FIG. 2, passage of ink 10 inside ink tank 1 is allowed only through the channels between ink tank partitioning element 16 and barrel 1. In this embodiment, ink can also pass through feeder core 2. Therefore, also in this case both the upper and lower writing points (point assemblies) 6 can deliver ink for writing until ink 10 inside ink-tank 1 is used up.

The means against forward leakage of this embodiment is also provision of ink feeder portions 14. Since a meniscus is formed at air/liquid exchanger 12, this inhibits air from entering ink tank 1 through air/liquid exchanger 12 of the upper ink collector 5 at the top whereby it is possible to prevent forward ink leakage from writing point (point assembly) 6 at the bottom end. Also in this case, since ink 10 is stored in the approximately center within ink tank 1, it is possible to shorten its distance from air/liquid exchanger 12. Therefore, it is possible to wet air/liquid exchanger 12 in a more positive manner and hence effectively prevent forward leakage.

Further, since part of ink 10 is held as ink pool 34, when air in space 8 inside ink tank 1 expands due to increase in temperature, decrease in pressure or other reasons, the amount of ejection to the outside of the pen will decrease proportionally to the volume of ink pool 34. As a result it is possible to reduce ink ejection or flooding compared to the configuration where no ink pool 34 is formed with ink tank partitioning element 16.

Figure 8:
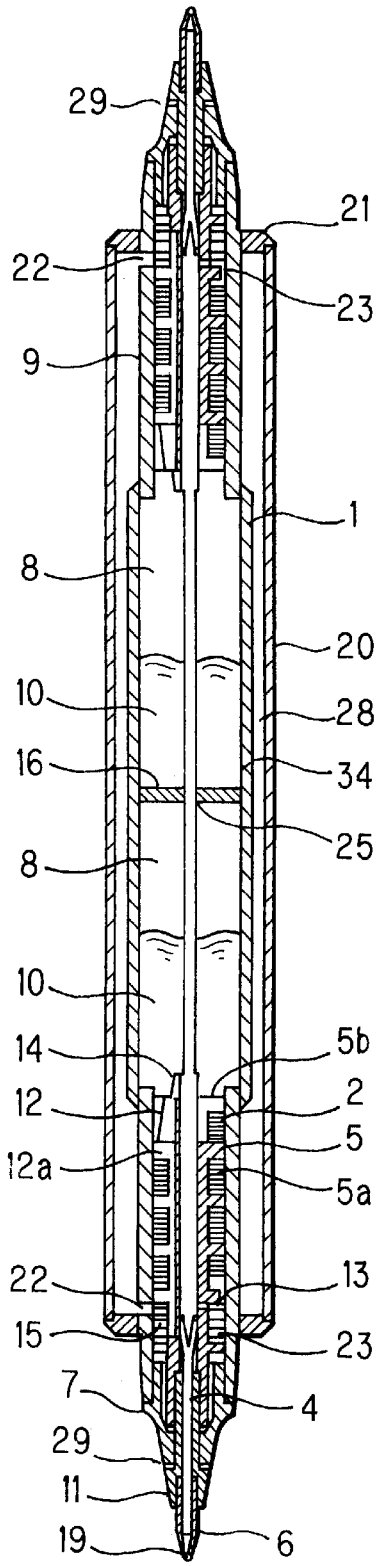
FIG. 8 is a vertical sectional view showing the overall configuration of a writing implement in accordance with the sixth embodiment of the present invention.

FIG. 8 is a vertical sectional view showing the overall configuration of a writing implement in accordance with the sixth embodiment of the present invention. The present embodiment is characterized in that the ink collector space 23 of one ink collector 5 and that of the other ink collector 5 are connected to each other by way of an air flow channel 28. Ink collector space 23 is the space in which ink collector 5 is disposed and which retains ink in order to prevent ink ejection or flooding.

This embodiment is the double ended direct-feed type writing implement shown in the third embodiment being enclosed by an outer barrel 20 with lids 21 at both ends of the outer barrel. Further, the upper and lower barrels 9 are formed with ink collector vent holes 22. As a result, an air flowing passage 28 is defined by barrels 9, ink tank 1 and outer barrel 20 so that the ink collector space 23 of ink collector 5 on one end is connected to that on the other end by way of air flowing passage 28.

Normally, when the double ended direct-feed type writing implement is used, the cap(not shown) for the writing point (point assembly) at the bottom side is off for writing while the cap at the top side remains on. If no ink collector vent hole 22 is provided for barrels 9, writing point vent hole 29 at the writing point (point assembly) 6 at the top will be confined by the cap. In this case, if air in space 58 inside ink tank 1 expands due to increase in temperature or any other reason, no expanded air can escape through writing point vent hole 29 to the open air outside the pen body, hence all the expanded air serves as the pressure forcing ink to discharge out through the writing point vent hole 29 of writing point (point assembly) 6 at the bottom, resulting in failure to reduce ink ejection or flooding.

In this embodiment, even when the cap is put on the writing point (point assembly) 6 at the top. hence the writing point vent hole 29 is confined, the expanded air inside the upper space 8 passes through ink collector vent hole 22 at the top and enters ink collector vent hole 22 at the bottom by way of air flowing passage 28, whereby the air is discharged through the writing point vent hole 29 at the bottom where the cap is off. In this case, similar to the third embodiment with no cap on, it is possible to reduce ink ejection or flooding when air inside space 8 expands due to increase in temperature or any other reason. Here in this embodiment, air flowing passage 28 is formed by providing outer barrel 20, but this should not limit the invention. That is, as long as air can be exchanged between the ink collector space 23 of one ink collector 5 and that of the other ink collector 5, a tube, for example, may be used to create an air flow passage 28, not sticking to the configuration with the outer barrel.

Figure 9:
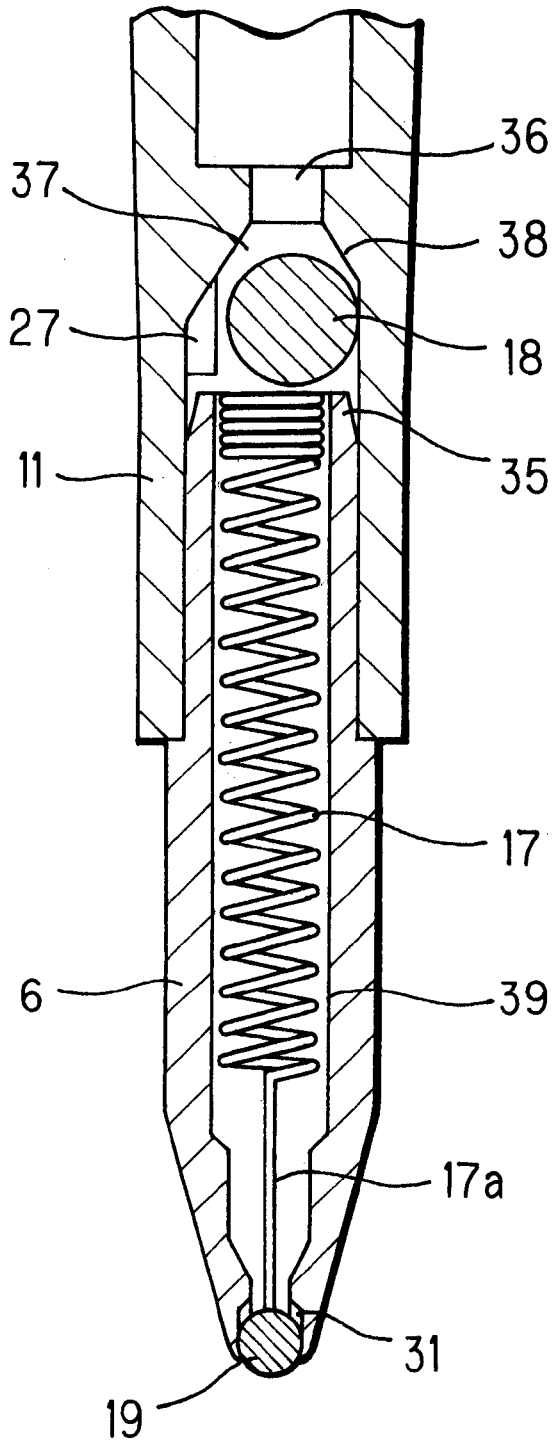
FIG. 9 is a vertical sectional view showing a writing point (point assembly) having a spring.

FIG. 9 shows a ball-point type writing point (point assembly) 6 to be used at least one end of a double ended direct-feed type writing implement. This configuration is characterized in that a spring 17 is inserted into the bore, designated at 39, of writing point (point assembly) 6 so as to urge the rear side of a writing ball 19 which is rotatably held at the distal end of writing point (point assembly) 6, whereby writing ball 19 comes into hermetic contact with the inner brim of the ball holder at writing point (point assembly) 6 for prevention against leakage of ink 10. Further, a joint 11 is connected to the rear end of writing tip of point assembly 6 and has a valve chamber 37 at its rear end. Formed at the rear of valve chamber 37 is a tapered or spherical ball valve seat 38. A ball valve 18 is idly held in valve chamber 37. When the writing point (point assembly) 6 is set upward, ball valve 18 rests on forming close contact with ball valve seat 38 so as to close the conduit, designated at 36, fluid-tightly to thereby prevent backward leakage of ink 10. When the writing point (point assembly) 6 is set downwards, the hermetic contact state is released so as to allow ink 10 to flow into writing point (point assembly) 6. The thus configured writing point (point assembly) 6 constitutes at least one of the writing points of a double ended direct-feed type writing implement.

The front part of writing point (point assembly) 6 is crimped so that writing ball 19 is substantially abutted against a writing ball seat 31 having a channel through which ink can flow in, and is held rotatably. Spring 17 is inserted into point assembly bore 39 of writing point (point assembly) 6 and the rear end of writing point (point assembly) 6 is suitably crimped (35) so as to prevent the rear end of spring 17 from coming out. Spring 17 has a straight portion 17*a* at its front side. The distal end of straight portion 17*a* abuts and presses the rear side of writing ball 19. Here, writing ball 19 is urged by spring 17 against the inner brim of the ball holder (formed by crimping or etc.) of writing point (point assembly) 6, in a fluid-tight manner.

As a result, no air will enter from writing point (point assembly) 6 at the top, so that it is possible to prevent forward leakage more effectively. This configuration also functions to prevent forward leakage at the writing point (point assembly) 6 at the bottom. Since this configuration functions like a lid except during writing, the flow of ink can be stopped. During writing, writing ball 19 is pressed by the paper surface(not shown) so the ball slightly moves toward writing ball seat 31, forming a clearance which allows ink to flow out. As writing ball 19 rolls during writing, ink can be distributed for writing.

When ball valve 18 is provided between writing point (point assembly) 6 and joint 11, the ball valve 18 moves down in the writing point (point assembly) 6 at the top, and abuts the inner surface of the joint 11, thus creating a sealing surface. Therefore, also in this case, no air will enter through the upper writing point (point assembly) 6, thus further enhancing prevention against forward leakage. The ink channel, designated at 27, is an ink feed passage for securing ink supply to writing point (point assembly) 6 during writing. Unless this channel 27 is provided, ball valve 18 functions as a stopper at the rear end of writing point (point assembly) 6, making ink supply impossible. Though ball valve 18 of a spherical shape is used in this embodiment, the valve can be of any shape, for example, conical or tapered shape, as long as it can provide seal in corporation with joint 11.

Figure 10:
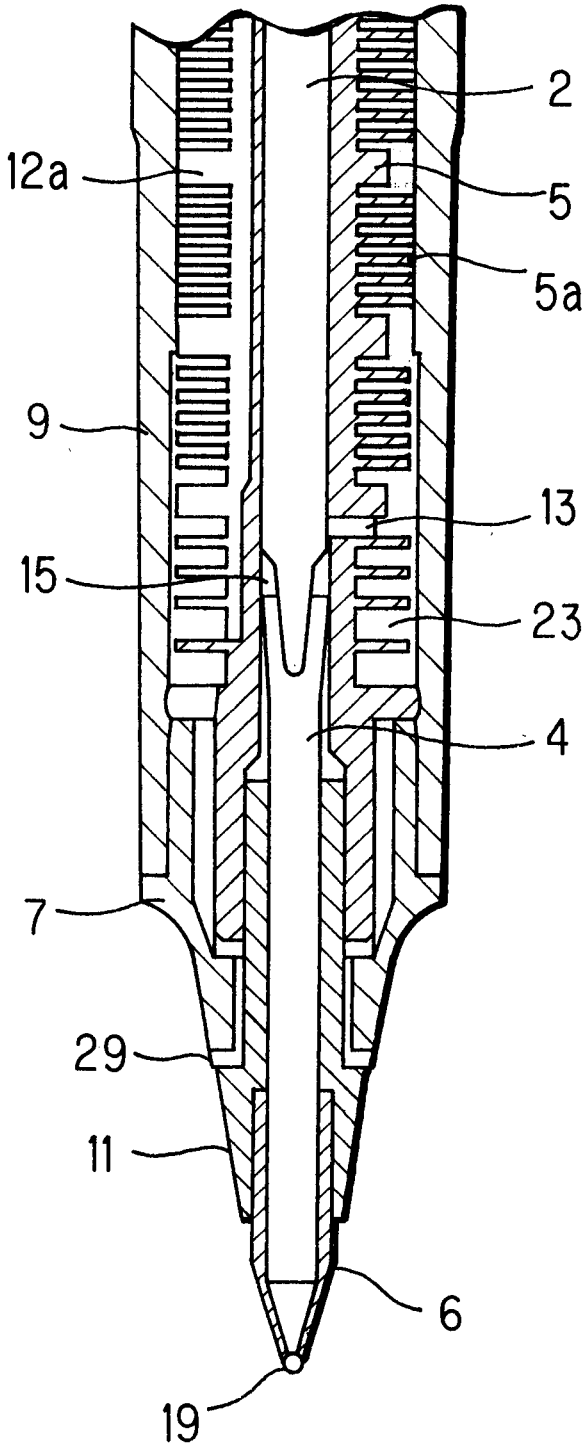
FIG. 10 is an enlarged vertical sectional view showing an ink collector having a fine hole.

FIG. 10 is an enlarged vertical sectional view showing an ink collector 5 having a fine hole 13. In this configuration, a fine hole 13 is formed between ink collector space 23 of ink collector 5 and ink conduit hole 15 in which the ink feeder means such as a center core etc., is disposed. This provision of fine hole 13 is effective in reducing forward leakage from writing point (point assembly) 6 at the bottom. That is, this configuration makes it easy for ink having come down along feeder core 2 to pass through this fine hole 13 and enter the space between vanes 5*a* of the ink collector. The reason ink easily enters the space between ink collector vanes 5*a* is that ball 19 of so-called ball-point (point assembly) as this writing point (point assembly) 6 functions as the stopper and ink collector vanes 5*a* produce capillarity. Therefore, ink is more liable to flow toward fine hole 13 than moving toward writing ball 19 of writing point (point assembly) 6.

Figure 11:
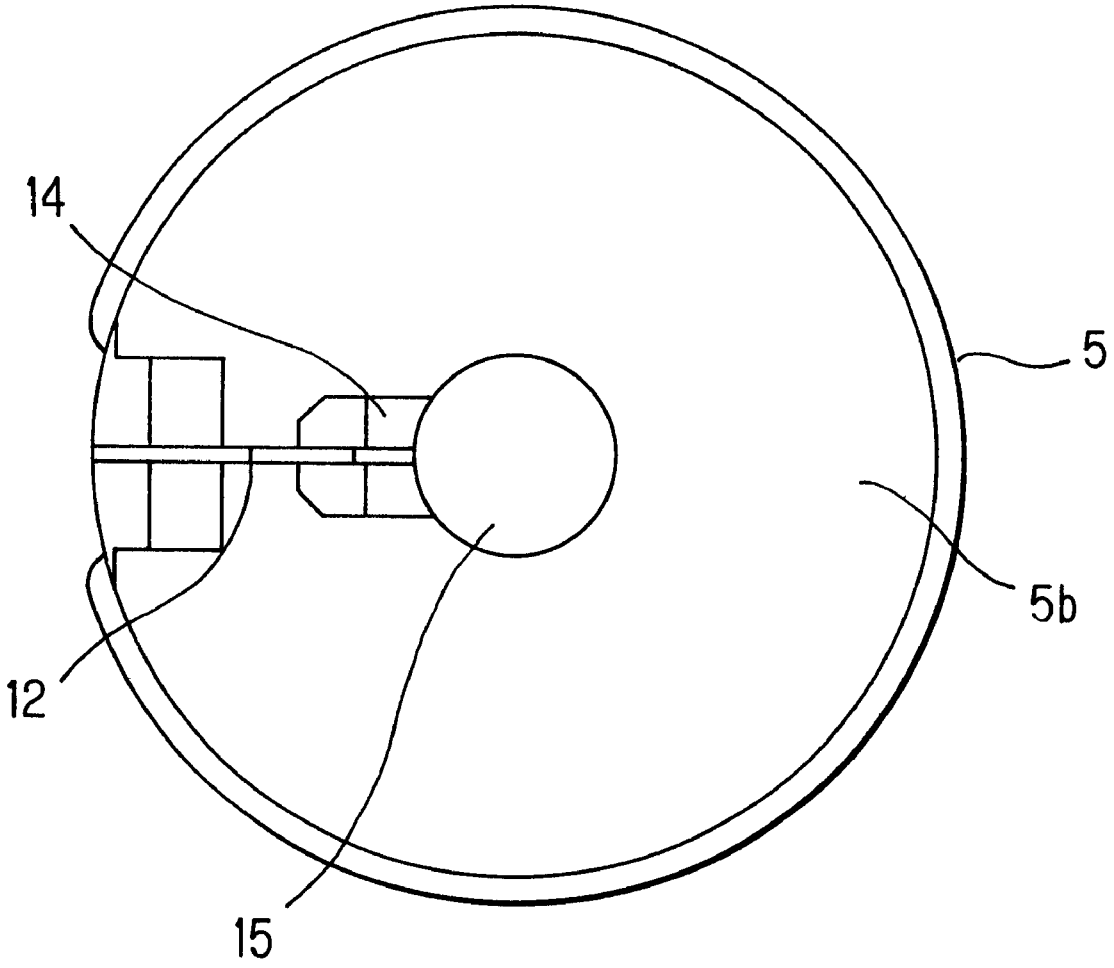
FIG. 11 is a plan view showing an ink collector having an ink feeder portion.

FIG. 11 is a plan view showing an ink collector 5 having an ink feeder portion 14. As described in the above embodiment, the first role of this ink feeder portion 14 is to form a meniscus at air/liquid exchanger 12 so as to inhibit air flow from the upper air/liquid exchanger 12 into ink tank 1 and thereby prevent forward leakage.

This ink feeder portion 14 is formed with a slit of 0.05 to 0.3 mm wide defined by two plate-like elements and is directly connected to the ink collector end face, designated at 5*b*. In the case where ink feeder portion 14 is provided, the slit presents capillarity because of its sufficiently small slit width. As a result, as the second role, the ink feeder portion 14 at the bottom leads ink 10 held in ink feeder means (2, 4) such as a center core, etc., or in ink absorbent element 32, to air/liquid exchanger 12 of ink collector 5, an ink channel (fine channel) 12*a* and the space between ink collector vanes 5*a*, whereby ink entrance to writing point (point assembly) 6 is reduced. Therefore, again in this case, the presence of ink feeder portion 14 makes it possible to reduce forward leakage from writing point (point assembly) 6 at the bottom.

As has been described, the above configurations enable provision of a double ended direct-feed type writing implement having an ink tank that can be directly filled up with raw ink.

Thus, the above configurations allow the residual quantity of ink to be monitored, assures a stable and consistent ink flow until ink end, and enables continuous flow of ink from both ends until the ink inside the ink tank is fully used up.

Further, the invention makes it possible to provide a double ended direct-feed type writing implement which is capable of holding ink directly inside its ink tank without using any ink absorbent element in the ink tank, still prevented from forward leakage which would occur when ink collectors are provided at both ends.

Moreover, the invention makes it possible to provide a double ended direct-feed type writing implement which is prevented from ink ejection or flooding due to decrease in pressure and increase in the temperature of the ink tank, which is the problem inherent in writing implements of a direct-feed type.

What is claimed is:

1. A double ended direct-feed type writing implement comprising:

an ink tank;

a pair of writing points as writing elements, arranged at opposite ends of the ink tank;

an ink collector provided for each writing point and having an air/liquid exchanger for adjusting the internal pressure inside the ink tank by making use of capillarity;

an ink feeder means, provided for each writing point, and including a center core for feeding ink to the writing point;

an ink tank partitioning element, formed inside the ink tank and each center core extends to an ink storage pool created by the ink tank partitioning element, and the ink tank partitioning element defines a plurality of channels between itself and a barrel of the writing implement defining the ink tank, whereby ink can flow through these channels; and means for inhibiting air from flowing into the ink tank through the ink collector air/liquid exchanger located at one end while the pen is being used for writing at the opposite end.

2. The double ended direct-feed type writing implement according to claim 1, wherein each feeder means and the center core are fluidly connected to each other.

3. The double ended direct-feed type writing implement according to claim 1, wherein the ink collectors are connected to each other by way of an air flow channel, and the ink is an ink of low viscosity having a viscosity ranging from 2 to 100 mPa·s at room temperature.

4. The double ended direct-feed type writing implement according to claim 1, wherein at least one of the writing points is of a ball-point type, and the ball-point type writing point has a spring inserted into a bore thereof and pressing a rear side of a writing ball rotatably held at a front part thereof, whereby the writing ball is abutted in fluid-tight contact with an inner brim of a ball holding portion of the writing points to prevent outflow of ink.

5. The double ended direct-feed type writing implement according to claim 1, wherein a rear end of the writing points is connected to a joint defining a valve chamber, the valve chamber having a tapered or spherical ball valve seat in the rear thereof and idly holding a ball valve therein, and when one of the writing point points is pointed upward, the ball valve is in close contact with the ball valve seat so as to close a conduit fluid-tightly and form a hermetic contact state to thereby prevent backward leakage of ink, and when one of the writing points is pointed downwards, the hermetic contact state is released so as to allow ink to flow into the writing points.

6. The double ended direct-feed type writing implement according to claim 1, wherein a fine hole is formed between the ink collector and the ink feeder means.

7. The double ended direct-feed type writing implement according to claim 1, wherein each ink collector includes an ink feeder portion for leading ink held in the ink feeder means to the air/liquid exchanger.

8. The double ended direct-feed type writing implement according to claim 1, wherein the means for inhibiting air from flowing into the ink tank includes forming an ink meniscus in the air/liquid exchanger located at the one end.

9. A double ended direct-feed type writing implement comprising:

an ink tank;

a pair of writing points as writing elements, arranged at opposite ends of the ink tank;

an ink collector provided for each writing point and having an air/liquid exchanger for adjusting the internal pressure inside the ink tank by making use of capillarity;

an ink feeder means, provided for each writing point, and including a center core for feeding ink to the writing point;

an ink tank partitioning element with a passage hole formed therein is formed inside the ink tank, and the ink feeder means is penetrated through the passage hole of the ink tank partitioning element; and means for inhibiting air from flowing into the ink tank through the ink collector air/liquid exchanger located at one end while the pen is being used for writing at the opposite end.

10. The double ended direct-feed type writing implement according to claim 9, wherein each feeder means and the center core are fluidly connected to each other.

11. The double ended direct-feed type writing implement according to claim 9, wherein the ink collectors are connected to each other by way of an air flow channel, and the ink is an ink of low viscosity having a viscosity ranging from 2 to 100 mPa·s at room temperature.

12. The double ended direct-feed type writing implement according to claim 9, wherein at least one of the writing points is of a ball-point type, and the ball-point type writing point has a spring inserted into a bore thereof and pressing a rear side of a writing ball rotatably held at a front part thereof, whereby the writing ball is abutted in fluid-tight contact with an inner brim of a ball holding portion of the writing points to prevent outflow of ink.

13. The double ended direct-feed type writing implement according to claim 9, wherein a rear end of the writing points is connected to a joint defining a valve chamber, the valve chamber having a tapered or spherical ball valve seat in the rear thereof and idly holding a ball valve therein, and when one of the writing point points is pointed upward, the ball valve is in close contact with the ball valve seat so as to close a conduit fluid-tightly and form a hermetic contact state to thereby prevent backward leakage of ink, and when one of the writing points is pointed downwards, the hermetic contact state is released so as to allow ink to flow into the writing points.

14. The double ended direct-feed type writing implement according to claim 9, wherein a fine hole is formed between the ink collector and the ink feeder means.

15. The double ended direct-feed type writing implement according to claim 9, wherein each ink collector includes an ink feeder portion for leading ink held in the ink feeder means to the air/liquid exchanger.

16. The double ended direct-feed type writing implement according to claim 9, wherein the means for inhibiting air from flowing into the ink tank includes forming an ink meniscus in the air/liquid exchanger located at the one end.

* * * * *